United States Patent [19]

Petit

[11] Patent Number: 4,991,483

[45] Date of Patent: Feb. 12, 1991

[54] MOUTHPIECE FOR WIND INSTRUMENT, AND CORRESPONDING LIGATURE AND MOUTHPIECE COVER

[76] Inventor: Roger Petit, 27, boulevard de l'Est, 93340 Le Raincy, France

[21] Appl. No.: 454,942

[22] Filed: Dec. 22, 1989

[30] Foreign Application Priority Data

Dec. 23, 1988 [FR] France ..... 88 17117

[51] Int. Cl.[5] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,553,081 | 6/1923 | Humes | 84/383 R |
| 1,684,159 | 5/1925 | McVicker | 84/383 R |
| 1,896,814 | 2/1933 | Gemeinhardt | 84/383 R |
| 4,056,997 | 11/1977 | Rovner | 84/383 R |
| 4,258,604 | 3/1981 | Giokas | 84/383 R |
| 4,296,668 | 10/1981 | Lorenzini | 84/383 R |

FOREIGN PATENT DOCUMENTS 2586318 4/1985 France .

*Primary Examiner*—Brian W. Brown

*Attorney, Agent, or Firm*—Cushman, Darby & Cushman

[57] ABSTRACT

A wind instrument mouthpiece includes a reed (2) which is joined to the barrel (1) by a ligature (5) including a cradle (6), the edges of which are joined by a flexible, tension-resistant rod (7) including a nut for adjusting its length between said edges in order to adapt the ligature (5) to the dimensions of the barrel (1). This mouthpiece is also associated with a mouthpiece cover (14), which includes a slipcase (15) on the inside of which a spring device (16) is disposed, which is intended in the protection position to press the reed (2) of the instrument against the edge of the opening of the chamber (1*b*).

19 Claims, 2 Drawing Sheets

MOUTHPIECE FOR WIND INSTRUMENT, AND CORRESPONDING LIGATURE AND MOUTHPIECE COVER

FIELD OF THE INVENTION

The present invention relates to a mouthpiece for a wind instrument including at least one reed, the reed being connected to the mouthpiece barrel by a ligature which has the property of being adjustable with great latitude, for adaptation to the dimensions of the barrel. This reed instrument mouthpiece is also associated with a mouthpiece cover that is capable of adapting to different types of mouthpieces.

BACKGROUND OF THE INVENTION

A mouthpiece for a single-reed wind instrument traditionally includes a central conduit, a cylindrical portion or bore which communicates directly with the conduit of the instrument; the other portion, or chamber, is open to the outside on the lower face of the mouthpiece. The reed is a tongue of wood disposed on the opening of this chamber, and held on the mouthpiece by a ligature.

Ligatures used for wind instruments with reeds, such as clarinets or alto and tenor saxophones, are often cloth or metal ties which hold the barrel of the mouthpiece and the reed against one another, via at least one strap retainer. The type of ligature used most often includes a metal collar, the facing ends of which are moved toward one another by way of screws known as thumb screws, which cooperate with threaded sleeves provided on these ends. Retention is thus obtained perpendicular to the axis of the barrel; the intensity of this retention must be adjusted by moving the sleeves closer to or farther away from one another.

However, such ligatures allow no more than a narrow latitude of adjustment, and it is difficult to use the same ligature for two barrels of different types of wind instrument. Two facing sleeves of the same strap retainer are in fact generally quite close to one another in their position of repose, and to adapt the ligature to a barrel one can only either tighten the thumb screws until the sleeves touch, which admits only a narrow margin of adjustment, or loosen them to space the ends of the strap retainer apart, but then one is very quickly limited by the fact that the screw threading can at most only rest on the outer surface of the barrel; if it is loosened any more, it cuts into the barrel. Because of this narrow latitude of adjustment, one type of ligature is adaptable only to certain well defined types of mouthpiece, and there are about 15 different sizes of ligatures in existence.

Wind instrument mouthpieces are also generally associated with a mouthpiece cover, which is a cap in which the instrument mouthpiece can be locked, in particular by clamping the inner edges of the cap onto the ligature. This mouthpiece cover is a protection device, which is used when one wishes to store the instrument without removing the ligature and the reed. However, the mouthpiece covers in use thus far have been relatively rigid and non-deformable elements, and the same type of mouthpiece cover cannot be used for different shapes and sizes of barrels. Furthermore, the interior of a mouthpiece cover is generally in contact with only the portion of the ligature onto which it is wedged by friction. Hence the reed of the instrument is not retained in any way except by the ligature, and it often happens that, like any moistened wood, it deforms when it dries (it is said to "leave the table"), which is detrimental to the sonority of the reed.

SUMMARY OF THE INVENTION

The present invention proposes devices with which these disadvantages can be overcome. In particular, it proposes a ligature which permits great latitude of adjustment in its dimensions and is capable of adapting to barrels of different shapes, such as conical or cylindrical barrels, as well as different dimensions. Furthermore, in a device according to the invention, a virtually pointwise or line contact between the ligature on the one hand and the barrel of the mouthpiece and the reed on the other is obtained, rather than over surface strips as was the case until now. This property proves to enable a better tonal attack; the reed is not caught so tightly, and the vibrations ensue more quickly.

The invention also proposes a mouthpiece cover capable of adapting to mouthpieces of different sizes and shapes, and which, when it is in the protective position on the mouthpiece, retains the reed in place; a spring device can press the reed onto the edges of the opening of the chamber. The reed remains flat on the planar portion known as the "table".

Hence the subject of the invention is a wind instrument mouthpiece, including at least one reed having a vibrating portion and a tail, the tail of the reed being securely joined, via a ligature, to a barrel the interior of which is a bore extended by a chamber that is open on the vibrating portion of the reed. This ligature includes a cradle which presses the tail of the reed on the lower face of the barrel. This barrel is clasped partly by the cradle and partly, in complementary fashion, by at least one flexible, tension-resistant rod that joins the edges of the cradle. The rod includes a means of adjusting its length between the edges, to adapt the ligature to the dimensions of the barrel. The ligature is a constituent element of the mouthpiece.

Advantageously, the flexible rod is at least partially threaded and passes through at least one annular element solidly joined to the cradle. The threaded portion of this rod cooperates with at least one nut, which when the ligature is in position on the barrel presses on the edges of the annular element associated with it, to keep the rod under tension. The nut may be a split nut, and the end of the nut and the end of the associated annular element, which are intended to cooperate with one another, are substantially conically shaped.

Preferably, the portion of the cradle intended to be in contact with the reed is lined, at least partially vertically of the tail of the reed, with parts that elastically absorb vibration, these parts alone assuring the contact. The portions of the ligature in contact with the mouthpiece of the instrument may be provided with a lining that makes it possible to reduce their sliding with respect to the barrel. The flexible rod may be of deformable plastic material. The cradle may be made of a malleable, deformable metal, so that its edges can be moved apart or closer together with respect to one another without breakage.

In one embodiment, on the outer face of its cradle, it includes at least one interlocking means which comprises a hook projecting from the cradle. Additionally, it may include two interlocking means that are symmetrical with respect to the longitudinal plane of symmetry of the cradle and of the ligature.

The subject of the invention is also a mouthpiece of a reed wind instrument, which is associated with a mouthpiece cover that includes both a flexible slipcase, in which the reed and the chamber of the mouthpiece slide, and a spring device, which is disposed on the inside of the slipcase and which is intended, in the protection position, to press the reed of the instrument onto or toward the edge of the opening of the chamber. The slipcase includes an interlocking means which is capable of cooperating with a complementary means solidly joined with the mouthpiece, in order to keep the slipcase on the mouthpiece in a removable manner. On either side of an empty space comprising the receptacle of the mouthpiece, the spring device of the mouthpiece cover includes an elastic arc-shaped leaf, the concavity of which is oriented from its surface intended to be in contact with an element of the mouthpiece toward the opposed wall of the slipcase.

In a preferred embodiment, a cushioning pad is placed in the concave portion of the elastic leaf, the leaf being located, in the position of use, between the pad and the mouthpiece. It is also conceivable for the elastic leaf to be locally reinforced, toward the top of the mouthpiece, by a second leaf threaded into two slits of the elastic leaf and superimposed on it; this second leaf is intended, in the position of use, to promote sliding when the top of the mouthpiece is provided with a mouthpiece protector (of plastic material). The concavity of the second leaf is in the same direction as that of the first leaf, and its curvature is greater, the second leaf being displaced in the slits if friction so dictates.

The elastic leaves are advantageously obtained by folding a strip of an elastic and pliable material onto itself in four portions, along substantially parallel transverse lines; the two end portions of the folded strip are each longer than the central portion directly adjacent to them, and the leaves each comprise one of these end portions. Toward its free end, it is moreover possible to glue one of the end portions onto the central portion that is directly adjacent to it; the elastic leaf comprises the other end portion. Finally, the slipcase may include a tongue, which is at least partly elastically deformable in a direction intended to correspond, in the protection position, to the length of the mouthpiece. Preferably the tongue of this slipcase includes at least one hole, comprising an interlocking means for cooperation with a hook borne by the ligature associated with the mouthpiece.

When the ligature includes hooks, the hooks serve to engage a mute of the type described in French Patent Application FR No. 86.08441.

For better comprehension of the subject of the invention, an exemplary embodiment shown in the accompanying drawings will now be described, purely for purposes of illustration and in no way limiting the invention.

DESCRIPTION OF THE PREFERRED EMBODIMENT

Figure 1:
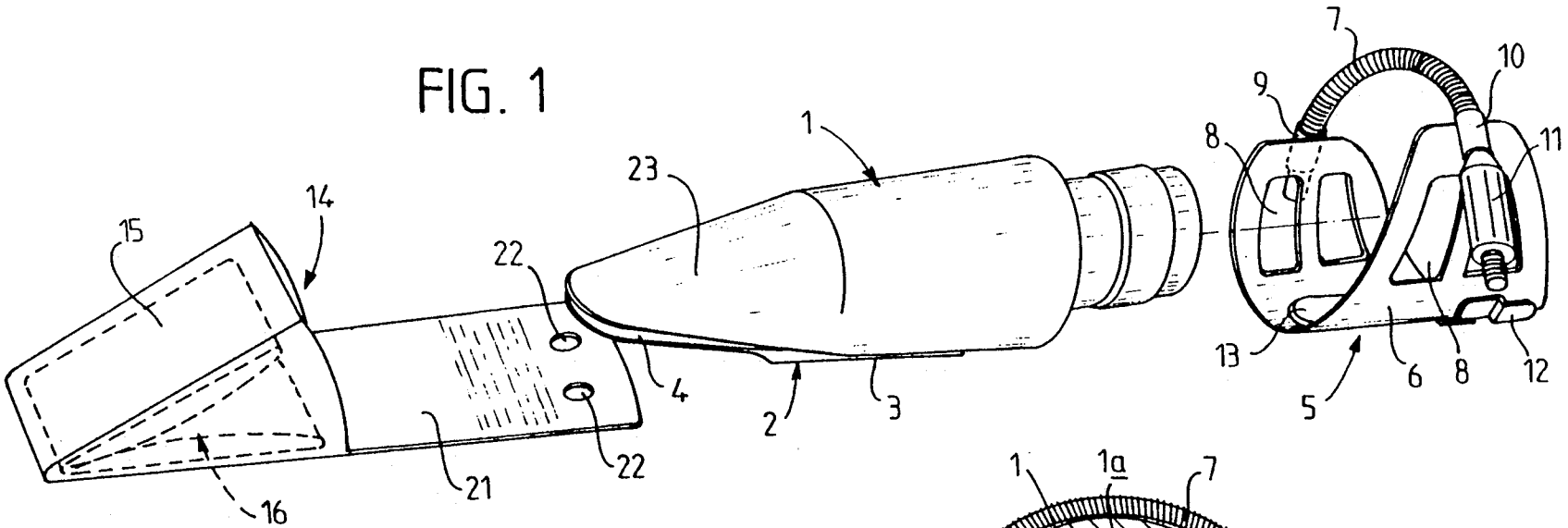
FIG. 1 is an exploded perspective view of a mouthpiece for a wind instrument, providing with a ligature and a mouthpiece cover according to the invention.
Figure 2:
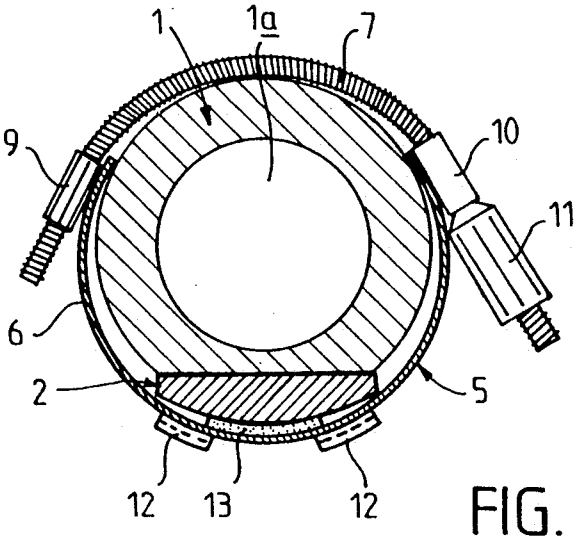
FIG. 2 is a sectional view of the mouthpiece and ligature of FIG. 1.
Figure 3:
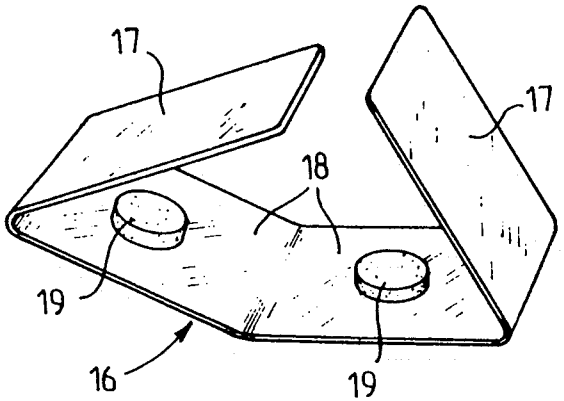
FIG. 3 is a perspective view of an element forming the spring device of a mouthpiece cover.
Figure 4:
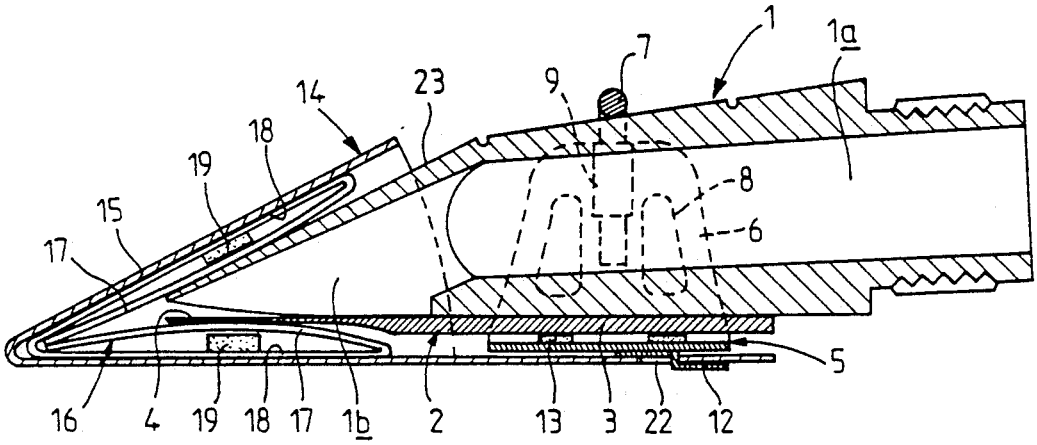
FIG. 4 is a view in longitudinal section of the elements of FIG. 1.

As can be seen in the drawings, the mouthpiece of the wind instrument includes a conical barrel 1, the inner walls of which define the bore 1*a* and which is extended by the chamber 1*b* of the instrument. A reed 2, which is an elongated tongue including a tail 3 and a vibrating portion 4, is positioned on the lower face of the barrel 1. The tail 3 is kept in contact over the length of the barrel 1 by a ligature 5, in such a way that the vibrating portion 4 of the reed 2 is positioned in front of the opening of the chamber 1*b* of the instrument.

The ligature 5 includes a cradle 6, the edges of which are joined by a flexible rod 7. The cradle 6 is an arc-shaped device in the form of an inverted saddle, which is intended to receive the reed 2 of the mouthpiece and press the tail 3 against the barrel 1. If this cradle 6 is imagined to be unfolded completely flat, then its cross section is substantially an ellipse, the long axis of which has a length of 65 mm and the short axis of which has a length of 25 mm. This cradle 6 is a metal part, for example of annealed brass, having a thickness of 0.4 mm, which in the variants may be of cloth or plastic material or may even be structured with alternating layers of metal and cloth or metal and plastic. Toward the edges of this cradle 6, two eyelet holes 8 are arranged on either side, symmetrically with respect to the plane of symmetry of the cradle 6, and are intended to assure flexibility for adaptation of the ligature 5 to various types of barrel 1. Affixed to each of the edges of the cradle 6 that are the farthest from its portion intended to receive the tail 3 is a cylindrical tube 9 and 10, the axis of each of which is located in the plane that symmetrically joins each of the holes 8 located on the same side of the cradle 6 with each other and is tangent to the outer surface of the cradle 6. The tubes 9 and 10 have an outer diameter of 4 mm and a length of 6 mm.

The tube 9 in the drawings is threaded on the inside, and a portion of the flexible rod 7 passes through it toward one of its ends. The inside diameter of the threading of the tube 9 is 2.5 mm, and its outer diameter is 3 mm. The rod 7 is of tension-resistant nylon, which is threaded over its entire length, with its threading cooperating with the threading of the cylindrical tube 9. The rod 7 may also be of a malleable metal, such as brass, for example. Toward its other end, the rod 7 passes through the tube 10, the smooth interior of which has a diameter of 3.2 mm. It is thus arc-shaped between the two tubes 9 and 10, with a concavity that is symmetrical with the concavity of the cradle 6 and with a substantially identical curvature. A nut 11, the edges of which engages the edge of the cylindrical tube 10, is screwed onto the threaded rod 7, toward its end at the level of the cylindrical tube 10, on the portion that extends past the tube 10 toward the outside of the ligature 5. The nut 11 is an elongated one and is slit over a portion of its length in one or more radial half planes; its end intended to be pressed against the edge of the cylindrical tube 10 is shaped as a cone having an angle of 23°. The length of the nut 11 is 13 mm; its outer diameter is 7 mm, and it includes a smooth hole 3 mm in diameter at the level of its conical portion. This allows rapid adjustment of the length of the flexible rod 7 between the two cylindrical tubes 9 and 10 by simple adjustment of the rod 7 in the nut 11 and the cylindrical tube 10. In a variant not shown, the rod 7 is threaded only at its ends.

The outer surface of the cradle 6 is provided with two interlocking tabs 12 disposed on the portion of the cradle 6 facing the threaded flexible rod 7, symmetrically with respect to the axis of the barrel 1. These two interlocking tabs 12 are intended for example to receive a mute of the kind described in French Patent Application FR No. 86.08441. This mute is a device that makes it possible to modify the volume of sound produced by wind instruments having a reed. It comprises an elastic band held in place, under tension, on the vibrating portion 4 of the reed 2, via the interlocking tabs 12 into which it is passed. The interlocking tabs may also be used to carry a mouthpiece cover. Additionally, the cradle 6 is equipped on its inside surface with two pads of synthetic foam 13, which are discs of slight thickness on which the tail 3 of the reed 2 comes to rest. These two pads 13 are disposed on the axis of the cradle 6. In the retaining position, the reed 2 is retained in pointwise contact by the pads 13 on the barrel 1, and the rod 7 clamps the mouthpiece of the instrument on the line of contact with this barrel 1. These pads 13 serve to prevent the reed 2 from directly contacting the metal of the cradle 6, which generates too many high-pitched harmonics. It is also possible to place the tail 3 of the reed 2 on three or four pads 13 distributed symmetrically on the cradle 6. However, excessive damping of the vibrations of the reed 2, must be prevented as well, because that would produce a muted sound. The number and positions of the pad 13 should thus be determined as a function of the sound sought by the user. The threaded rod 7 and the portions of the cradle 6 contacting the barrel 1 are lined with a rubber material intended to reduce sliding of the ligature 5 with respect to the barrel. For example, the threaded rod 7 may be partially sheathed vertically of the portion of the cradle 6 intended to be in contact with the tail 3.

In FIGS. 3-6, it is seen that the instrument mouthpiece is associated with a mouthpiece cover 14, which includes a slipcase 15 of triangular profile, on the inside of which the instrument mouthpiece slides. A spring device 16 is glued to the inside of this slipcase 15. This spring device 16 is an elongated rectangular strip of slight thickness made of plastic material and folded onto itself in four parts, symmetrically toward and with respect to a plane that is perpendicular to the strip when this strip is in the extended position and passes through its median width. The two end portions 17 of this spring device 16 are identical and are slightly longer than its two central portions 18. Once folded, the two end portions 17 thus form elastic leaves that rest on the contour of the mouthpiece, and in particular on the vibrating portion 4 of the reed 2. These elastic leaves 17 may be covered on their contact surface with Teflon in order to improve their coefficient of friction. A disc 19 of synthetic foam or a felt pad is glued onto each of the central portions 18, on the surface facing the end portions 17, and the elastic leaves 7 press on this pad when the mouthpiece 14 is in the protection position.

Figure 5:
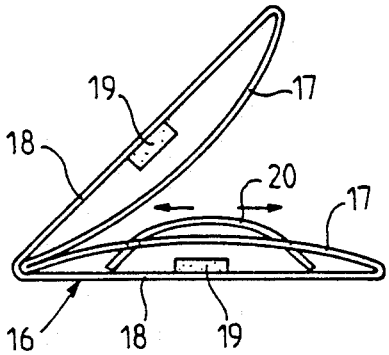
FIG. 5 is a side view of an element forming the spring device, in a variant according to the invention; and finally
Figure 6:
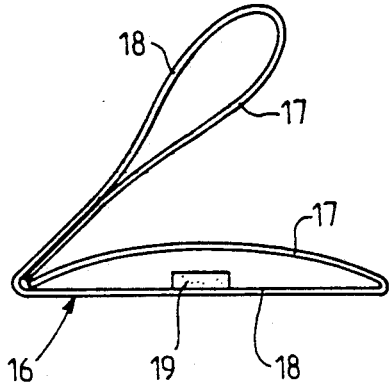
FIG. 6 is a side view of another element forming the spring device, in another variant according to the invention.

In a variant shown in FIG. 5, the elastic leaf 17 intended to be in contact with the top of the mouthpiece 23, in the region where the player of the instrument places his teeth, may be reinforced with a second leaf 20. This second leaf 20, having a width less than the width of the strip 16, is threaded at its two ends into two slits made in the width of the elastic leaf 17 mentioned above, on its side. Its central portion is thus positioned between the two leaves 17 and has a greater curvature than the leaf 17 carrying it. This second leaf 20 is intended to slide in the slits of the elastic leaf 17 carrying it, when friction dictates, as the arrows of FIG. 5 indicate. In another variant, shown in FIG. 6, one of the leaves 17 is glued, toward its free end, to the leaf 18 of the central portion of the strip 16, to which the other leaf 17 is juxtaposed, and this latter leaf is intended to contact the vibrating portion 4 of the reed 2.

The slipcase 15 is a leather sheath. In a variant, it is of a material identical to that of the strip 16. Its wall that is intended to face the reed 2 when it is the protection position is prolonged by a tongue 21 that includes an elastically lengthenable portion and is terminated at its free end by two attachment holes 22, which can engage the ligature 5, for example at the interlocking tabs or, if the ligature is a conventional ligature, at the thumb screws.

The mouthpiece cover as described above may also be advantageously used for a double reed system, such as that of the oboe.

What is claimed is:

1. A wind instrument mouthpiece, including at least one reed having a vibrating portion and a tail, said tail being joined by a ligature to a barrel having an interior and on the interior a bore having at one end thereof a chamber having an opening with said vibrating portion of said reed extending over at least a section thereof, said barrel having a lower face and exterior of selected size, said ligature including a cradle which presses the tail of the reed on the lower face of the barrel, said cradle having edges spaced a distance apart and connected by at least one member including a means of adjustment of the distance between said edges to adapt the ligature to the size of the barrel, characterized in that said one member is a flexible, tension-resistant rod, and the said barrel is clasped partly by said cradle and partly by said flexible rod.

2. The mouthpiece as defined by claim 1, characterized in that the flexible rod is at least partly threaded and passes through at least one annular element having an edge and joined to the cradle, the threaded portion of said rod cooperating with at least one nut which when the ligature is in position on the barrel presses on said edge of said annular element to keep said rod under tension.

3. The mouthpiece as defined by claim 2, characterized in that the nut is a split nut, said nut having one side provided with a conically shaped recess and said annular element having an end which is conically shaped to fit into said recess of said nut.

4. The mouthpiece as defined by one of claim 2-3, characterized in that said cradle has a portion in contact with the reed and which is lined, at least partially vertically of the tail of the reed, with parts that leastically absorb vibration, said parts assuring said contact.

5. The mouthpiece as defined by claim 4, characterized in that the ligature has portions in contact with the mouthpiece of the instrument and which are provided with a lining to reduce their sliding with respect to the barrel.

6. The mouthpiece as defined by claim 1, characterized in that the flexible rod is of a deformable plastic material.

7. The mouthpiece as defined by one of claims 1, 2 or 3, characterized in that the cradle is made of a malleable, deformable metal making it possible to move its edges apart or closer together with respect to one another without breakage.

8. The mouthpiece as defined by one of claims 1, 2, or 3, characterized in that said cradle has an outer face and said mouthpiece includes at least one interlocking means on the outer face of said cradle.

9. The mouthpiece as defined by claim 8, characterized in that the interlocking means comprises an interlocking tab that projects from the cradle.

10. The mouthpiece as defined by claim 9, characterized in that said mouthpiece includes two interlocking means, said cradle and said ligature having a plane of longitudinal symmetry and said two interlocking means are substantially symmetrical with respect to said plane of longitudinal symmetry of the cradle and of the ligature.

11. The mouthpiece as defined by claim 1, characterized in that said mouthpiece with a mute.

12. The mouthpiece as defined by claim 11 wherein said cradle has an outer face and having interlocking means on said outer face, said interlocking means comprising an interlocking tab that projects from said cradle and characterized in that the mute is held in place on the mouthpiece by means of the interlocking means with which the cradle of the ligature is provided.

13. The mouthpiece as defined by claim 1, characterized in that said mouthpiece is associated with a mouthpiece cover, which includes a flexible slipcase having an inside, in which the reed and the chamber of the mouthpiece slide, and a spring device, which is disposed on the inside of said slipcase and which, when said reed and chamber are disposed on said inside, presses the reed toward the opening of the chamber, said slipcase including an interlocking means which is capable of cooperating with a complementary means joined with the mouthpiece, in order to removably retain the slipcase on the mouthpiece.

14. The mouthpiece as defined by claim 13, characterized in that said slipcase of said mouthpiece has a receptacle defined by two walls and the spring device of the mouthpiece cover includes an elastic arc-shaped leaf having a surface for contacting the mouthpiece and a concavity which is oriented from said surface for contacting toward the facing wall of the slipcase.

15. The mouthpiece as defined by claim 14, characterized in that said elastic leaf has a concave portion on a side thereof opposite said concavity and a cushioning pad is placed in the concave portion of the elastic leaf, said leaf being located between said pad and the mouthpiece when said mouthpiece cover is disposed on said mouthpiece.

16. The mouthpiece as defined by claim 15, characterized in that said mouthpiece has a top wall, the elastic leaf has two slits and being locally reinforced by a second leaf having opposite ends each disposed in a said slit of the elastic leaf and superimposed on it, said second leaf being in contact with the top wall of the mouthpiece, said second leaf having a concavity which extends in the same direction as that of the elastic leaf.

17. The mouthpiece as defined by claim 16, characterized in that the elastic leaves comprise strips of an elastic and pliable material each folded onto itself in four portions, along substantially parallel transverse lines and including two end portions and a central portion, the two end portions of each said folded strip each being longer than the central portion directly adjacent thereto, said leaves each comprising one of said end portions.

18. The mouthpiece as defined by claim 17, characterized in that one of the end portions of the folder strip has a free end and is glued, toward said free end, onto the central portion that is directly adjacent thereto.

19. The mouthpiece as defined by one of claim 13–18, characterized in that the mouthpiece has a length and the slipcase includes a tongue, which is at least partly elastically deformable in a direction corresponding to the length of the mouthpiece, and said tongue includes at least one hole comprising an interlocking means intended for cooperation with a hook borne by the ligature associated with the mouthpiece.

* * * * *